US005623999A

United States Patent [19]

Linsbauer et al.

[11] Patent Number: 5,623,999

[45] Date of Patent: Apr. 29, 1997

[54] HAND-OPERATED TOOL

[75] Inventors: Peter Linsbauer, Remshalden; Jochen Kramer, Waiblingen, both of Germany

[73] Assignee: Andreas Stihl, Waiblingen, Germany

[21] Appl. No.: 505,795

[22] Filed: Jul. 21, 1995

[30] Foreign Application Priority Data

Jul. 22, 1994 [DE] Germany ..... 94117866 u

[51] Int. Cl.[6] ..... B25F 3/00; B25F 5/02; B24B 23/00

[52] U.S. Cl. ..... 173/170; 173/171; 16/110 R

[58] Field of Search ..... 173/170, 162.1, 173/162.2, 171; 16/110 R, 115, 111 A

[56] References Cited

U.S. PATENT DOCUMENTS 936,870 10/1909 Dundley et al. ..... 173/170

1,850,191 3/1932 Wilcox ..... 173/170

2,274,817 3/1942 Zimmer ..... 16/110 R 3,525,373 8/1970 Kobayashi et al. ..... 173/162.1

3,835,535 9/1974 Robison et al. ..... 16/115

*Primary Examiner*—Scott A. Smith

*Attorney, Agent, or Firm*—Robert W. Becker & Associates

[57] ABSTRACT

A hand-operated tool has a casing containing a motor for driving a tool member of the tool and a metallic tubular grip with a tube wall connected to the casing. The tube wall of the tubular grip has a profiled outer mantle surface made by deforming the tube wall. The profiled outer mantle surface has raised sections and indentations extending in the longitudinal direction of the tubular grip.

11 Claims, 2 Drawing Sheets

HAND-OPERATED TOOL

BACKGROUND OF THE INVENTION

The present invention relates to a hand-operated tool, for example, a cut-off machine, a motor chainsaw etc., with a tubular grip made of metal.

In known hand-operated tools of this type the supporting tubular member of the tubular grip is made of steel or aluminium with a smooth surface. In order that the tool can be held securely this metal tube is given a coating of rubber or flexible plastic and is ribbed. However, ribbing of this type allows adequately secure handling of the tool only while the rubber coating is securely bonded to the steel tube and undamaged. Rubber is not resistant to ageing and tends in particular to become brittle at extreme temperatures whereby the secure hold on the metal tube is lost. In addition, the coating can be easily damaged or destroyed by mechanical forces making it impossible to continue to hold the tool securely.

It is therefore an object of the present invention to ensure a permanent secure handling of the tool with the tubular grip.

SUMMARY OF THE INVENTION

The hand-operated tool according to the present invention is primarily characterized by:

- a casing containing a motor for driving a tool member of the tool;
- a metallic tubular grip with a tube wall connected to the casing;
- the tube wall of the tubular grip having a profiled outer mantle surface made by deforming the tube wall;
- the profiled outer mantle surface having raised sections and indentations extending in the longitudinal direction of the tubular grip.

The profiled outer mantle surface, when viewed in cross-section transverse to the longitudinal direction of the tubular grip, comprises a plurality of adjacently arranged arcs, wherein the radii of the arcs are smaller than the radius of the tubular grip.

Preferably, a center point of each one of the arcs is located substantially at half a distance between an inner wall surface of the tubular grip and a central axis of the tubular grip.

Each one of the arcs has a point of maximum radial extension relative to a central axis of the tubular grip and wherein an angle, measured relative to the central axis of the tubular grip, between the points of maximum radial extension of neighboring ones of the arcs is 20° to 72° . The angle is preferably 30° to 45°.

The outer mantle surface has a maximum radius at the points of maximum radial extension and a minimum radius at the indentations, wherein the minimum radius and the maximum radius differ from one another by at least 3% and at most 20%. Expediently, the minimum radius and the maximum radius differ from one another by 5%.

The radii of the arcs are preferably identical.

The tube wall has a uniform thickness over a circumference of the tubular grip.

Advantageously, the tube wall is comprised of light metal, preferably aluminum alloy.

The tubular grip is expediently made by extrusion.

A tool designed in this way can be held securely by the tubular grip without the need to provide a ribbed rubber or plastic coating on the tubular grip.

The elimination of this coating also reduces production costs. It retains the advantages of a tubular metal grip, namely high rigidity, load-bearing capacity and shock and impact resistance. A thin layer or covering of plastic might be provided for the purposes of insulation which would not impair the efficiency of the metal tube.

Ideally, the profiling consists of a series of adjacent arcs, the radii of which are smaller than the radius of the tubular grip. These arcs form the lengthwise-running raised sections whereby the transition between two adjacent arcs forms an indentation. The number of arcs around the circumference of the tube and their radius of curvature affect the degree of the profiling and it is important to ensure that the indentations are not too narrow, or the raised sections too sharp. Ideally, all the arcs have the same radius, thus making the profiling uniform around the entire surface of the tubular grip, and an angle, measured relative to the central axis of the tubular grip, between the points of maximum radial extension of neighboring arcs is between 20° and 72°, whereby angles of 30° to 45° are considered to be particularly suitable. Ideally, the tubular grip is made of an aluminium alloy and manufactured using an extrusion process.

BRIEF DESCRIPTION OF THE DRAWINGS

An embodiment of the tubular grip is described below with the help of the drawing. The figures in the drawing represent the following.

DESCRIPTION OF PREFERRED EMBODIMENTS

Figure 1:
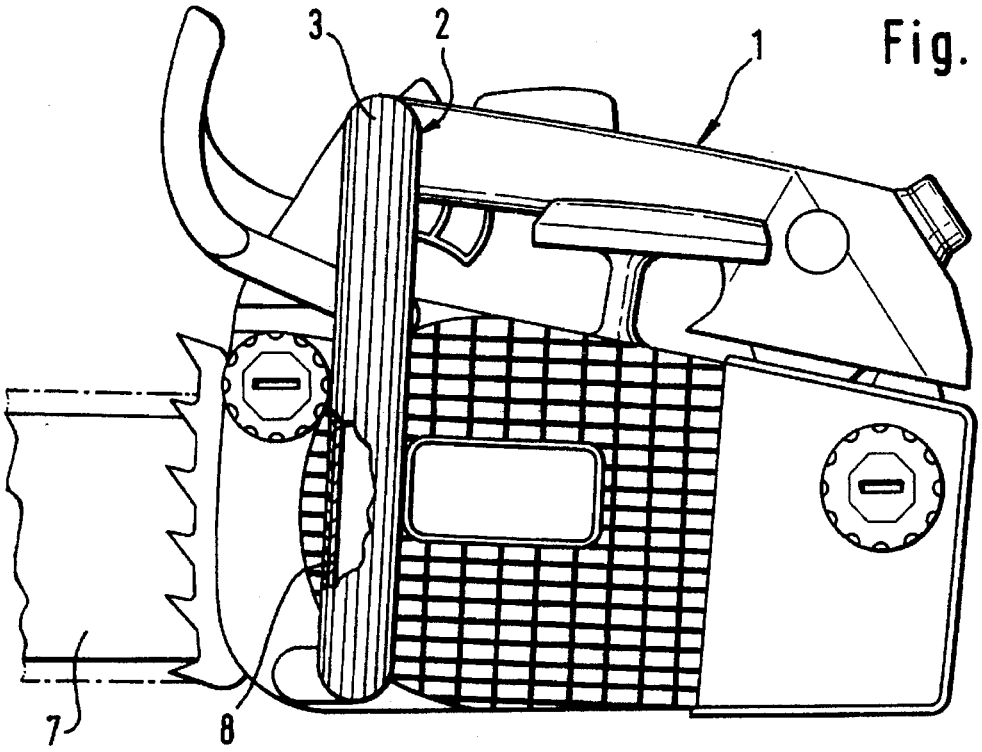
FIG. 1 The motor casing of a chain saw with a tubular grip according to prior art.

FIG. 1 shows the motor casing 1 of a chain saw with a tubular grip 2 on the side of the blade. The tubular grip 2 consists of a steel or aluminium tube 8 with a smooth outer surface to which a rubber or plastic coating 3 is applied. The coating 3 is provided with numerous ribs running lengthwise along the tubular grip 2.

Figure 2:
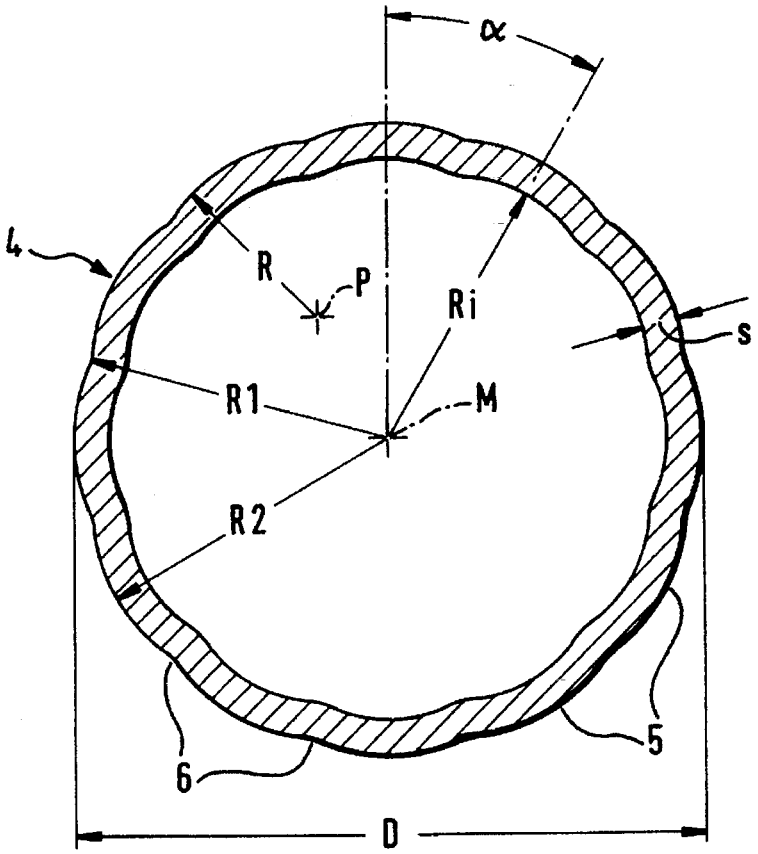
FIG. 2 A profiled tubular grip as described in the invention in cross section.

FIG. 2 shows a radial section of a tubular grip 4 which consists, in the embodiment, of an extruded aluminium section. The surface of the tubular grip forms the profiling in that the material of the tubular grip forms a series of adjacent arcs 5. Indentations 6 are thus formed between each two adjacent arcs 5. The arcs 5 are segments of a circle with a radius R which is considerably smaller than the largest internal radius of the tubular grip marked Ri. The thickness s of the wall of the tubular grip is constant around the entire circumference.

In the embodiment shown in FIG. 2 the radius R of arc 5 is roughly half the internal radius Ri of the tubular grip 4, whereby the mid point P of the arc 5 lies roughly centrally between the central axis M of the tubular grip 4 and the inner wall of the tube. The radius of the tubular grip is at its greatest R2 at the point of maximum radial extension of each arc 5, while the indentations 6 form the points at which the radius is at its smallest R1. Insofar as there is an even-numbered arrangement of arcs 5 and all arcs have the same radius R, the largest diameter D of the tubular grip 4 is determined by two maximum radial extensions of two diametrically opposed diagonal raised sections. Other divisions different to those in the embodiment shown may be used in which the central angle $\alpha$ between the radials extending from the central axis M which pass through the points of two adjacent raised sections is 30°. For example, the angle α may lie within the range 20° to 72°.

The number of arcs 5, their radii R and the position of the center point P influence the radii R1 and R2. The difference between R1 and R2 depends essentially on the number of arcs 5 and their radius of curvature. The profiling is described by specifying this parameter, i.e. a large difference between R1 and R2 gives deep profiling on the tubular grip.

Figure 3:
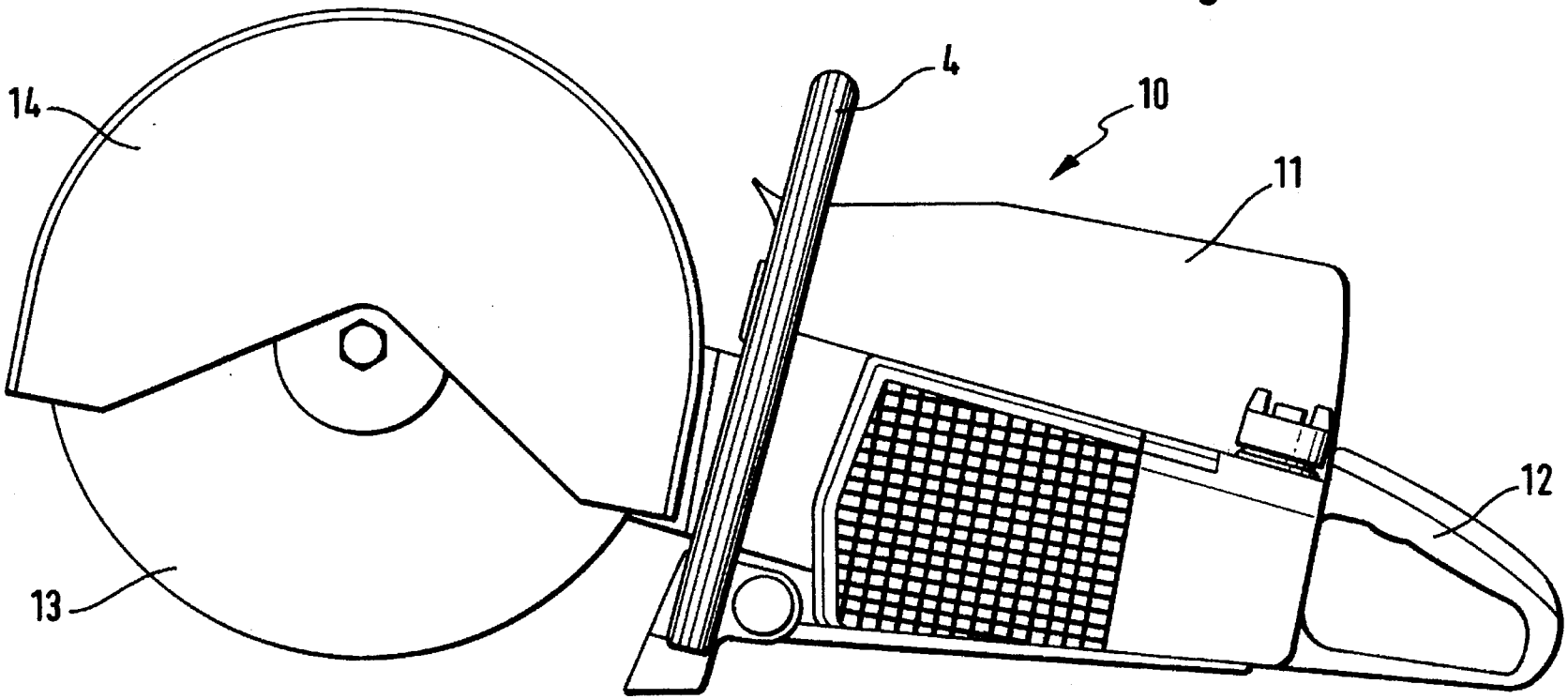
FIG. 3 A parting-off grinder with a tubular grip as described in FIG. 2.

FIG. 3 shows a parting-off grinder (cutter) 10 with a motor casing 11 and a handle 12. On the side of the motor casing 11 opposite the handle 12 is an output shaft which is driven by a V-belt and to which the parting-off wheel 13 is attached. Roughly two thirds of the parting-off wheel 13 are covered by a safety hood 14. The tubular grip 4, which extends in a U-shaped form at an adequate distance from the motor casing 11, is attached to the side of the motor casing 11 facing the parting-off wheel 13. The present invention is, of course, in no way restricted to the specific disclosure of the specification and drawings, but also encompasses any modifications within the scope of the appended claims.

What I claim is:

1. A hand-operated tool comprising:

a casing containing a motor for driving a tool member of said tool;

a metallic tubular grip with a tube wall connected to said casing;

said tube wall of said tubular grip having a profiled outer mantle surface made by deforming said tube wall;

said profiled outer mantle surface having raised sections and indentations extending in a longitudinal direction of said tubular grip over an entire length of said tubular grip;

wherein said profiled outer mantle surface, when viewed in cross-section transverse to said longitudinal direction of said tubular grip, comprises a plurality of adjoining arcs, wherein radii of said adjoining arcs are smaller than a radius of said tubular grip; and wherein each one of said arcs projects outwardly relative to a central axis of said tubular grip to form said raised sections.

2. A hand-operated tool according to claim 1, wherein a center point of each one of said arcs is located substantially at half a distance between an inner wall surface of said tubular grip and a central axis of said tubular grip.

3. A hand-operated tool according to claim 2, wherein each one of said arcs has a point of maximum radial extension relative to a central axis of said tubular grip and wherein an angle, measured relative to said central axis of said tubular grip, between said points of maximum radial extension of neighboring ones of said arcs is 20° to 72°.

4. A hand-operated tool according to claim 3, wherein said angle is 30° to 45°.

5. A hand-operated tool according to claim 3, wherein said outer mantle surface has a maximum radius at said points of maximum radial extension and a minimum radius at said indentations, wherein said minimum radius and said maximum radius differ from one another by at least 3% and at most 20%.

6. A hand-operated tool according to claim 5, wherein said minimum radius and said maximum radius differ from one another by 5%.

7. A hand-operated tool according to claim 1, wherein said radii of said arcs are identical.

8. A hand-operated tool according to claim 1, wherein said tube wall has a uniform thickness over a circumference of said tubular grip.

9. A hand-operated tool according to claim 1, wherein said tube wall is comprised of light metal.

10. A hand-operated tool according to claim 9, wherein said tube wall is comprised of aluminum alloy.

11. A hand-operated tool according to claim 1, wherein said tubular grip is made by extrusion.

* * * * *

UNITED STATES PATENT AND TRADEMARK OFFICE

CERTIFICATE OF CORRECTION

PATENT NO. : 5,623,999

DATED : April 29, 1997

INVENTOR(S) : Linsbauer et al

It is certified that error appears in the above-indentified patent and that said Letters Patent is hereby corrected as shown below:

On the title page:

[30] Foreign Application Priority Data

Jul. 22, 1994 [DE] Germany ..... 9411866

Signed and Sealed this

Twenty-second Day of July, 1997

Bruce Lehman

*Attest:*

BRUCE LEHMAN

*Attesting Officer*

*Commissioner of Patents and Trademarks*